US008292530B2

(12) United States Patent
Tamano et al.

(10) Patent No.: US 8,292,530 B2
(45) **Date of Patent: *Oct. 23, 2012**

(54) KNOCK TYPE WRITING INSTRUMENT

(75) Inventors: Hisami Tamano, Kanagawa (JP); Yoshiharu Namiki, Kanagawa (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 564 days.

This patent is subject to a terminal disclaimer.

(21) Appl. No.: 12/449,059

(22) PCT Filed: Jan. 18, 2008

(86) PCT No.: PCT/JP2008/051018

§ 371 (c)(1),
(2), (4) Date: Jul. 22, 2009

(87) PCT Pub. No.: WO2008/090966

PCT Pub. Date: Jul. 31, 2008

(65) Prior Publication Data

US 2010/0003062 A1 Jan. 7, 2010

(30) Foreign Application Priority Data

Jan. 23, 2007 (JP) ..... 2007-013009

(51) Int. Cl.
*B43K 5/16* (2006.01)
*B43K 7/12* (2006.01)
*B43K 24/08* (2006.01)

(52) U.S. Cl. ..... 401/106; 401/105; 401/110; 401/131

(58) Field of Classification Search ..... 401/104–106, 401/110–113, 131

See application file for complete search history.

(56) References Cited

U.S. PATENT DOCUMENTS 6,336,761 B1 1/2002 Kudo
6,390,706 B1 * 5/2002 Yokouchi et al. ..... 401/104

(Continued)

FOREIGN PATENT DOCUMENTS

EP 1 092 564 A1 4/2001

(Continued)

OTHER PUBLICATIONS

International Search Report mailed Apr. 22, 2008, in PCT/JP2008/051018, 4 pages.

(Continued)

*Primary Examiner* — David Walczak
*Assistant Examiner* — Bradley Oliver
(74) *Attorney, Agent, or Firm* — Foley & Lardner LLP

(57) ABSTRACT

A slide body (6) is arranged in a cut-away portion of a holder (1) under a clip (2*a*) so as to not hinder writing or portability, and a safety mechanism is constituted so as to be engaged with the clip (2*a*). Due to functions of a knock rod cam (4*a*) of a knock rod (4) and a knock cam (3*a*) of a rotor (3), further, the rotor (3) is rotated and moved forward responsive to each knocking operation, a refill (7) is brought to a writing position and a holding position alternately responsive to each knocking operation due to a cam mechanism provided in the inner wall of an inner cylinder (2) and a reactive force of a spring (5). A slide body cam (6*a*) provided on the slide body (6) is incorporated in a portion of the cam mechanism so that the knock type writing instrument thrusts the pen point out, by one knock even after the safety operation.

4 Claims, 10 Drawing Sheets

U.S. PATENT DOCUMENTS

| | | | | |
|---|---|---|---|---|
| 6,390,707 | B2 * | 5/2002 | Kageyama et al. | 401/104 |
| 7,581,896 | B2 * | 9/2009 | Yoon | 401/106 |
| 7,931,415 | B2 * | 4/2011 | Namiki et al. | 401/106 |
| 2001/0005467 | A1 | 6/2001 | Lin | |
| 2008/0107469 | A1 * | 5/2008 | Yoon | 401/104 |

FOREIGN PATENT DOCUMENTS

| | | | |
|---|---|---|---|
| EP | 1 153 767 | A2 | 11/2001 |
| JP | 9-118095 | A | 5/1997 |
| JP | 9-175083 | A | 7/1997 |
| JP | 2001-105785 | A | 4/2001 |
| JP | 2003-211894 | A | 7/2003 |
| JP | 2004-167766 | A | 6/2004 |
| JP | 2004-167767 | A | 6/2004 |
| JP | 2008-006790 | A | 1/2008 |

OTHER PUBLICATIONS

Supplementary European Search Report dated Apr. 28, 2011, in corresponding EP 08703845.1, 6 pages.

* cited by examiner

KNOCK TYPE WRITING INSTRUMENT

CROSS-REFERENCE TO RELATED APPLICATIONS

This application is a National Stage application of PCT/JP2008/051018, filed Jan. 18, 2008, which claims priority from Japanese application JP 2007-013009, filed Jan. 23, 2007.

TECHNICAL FIELD

This invention relates to a knock-type writing instrument.

BACKGROUND ART

Among knock-type writing instruments, one type in which a pen point thrusts out upon depressing a knock rod at the rear end of the holder and draws back upon depressing the knock rod again, is called a double knock-type writing instrument. Further, some knock-type writing instruments comprise a safety mechanism such that when cloth or paper is held by a clip, a nub of the clip is disengaged causing the pen point to draw back.

Writing instruments of several double-knock types have heretofore been known being equipped with the safety mechanism. Here, the safety mechanism means is a mechanism which when a tip of the clip is lifted up in a state where the pen point is at the writing position protruding beyond the end of the holder, the pen point draws back into the holding position in the holder. By this mechanism, clothing will not be stained in case the writing instrument is inserted in, for example, a chest pocket of clothing with the pen point extended.

Japanese Patent No. 3681203 discloses a double knock-type writing instrument of the cam knock system, wherein when a nub of a clip engages with a protuberance of a rotor causing the rotor to stop rotating at a writing position, the writing can be effected. It discloses a safety mechanism, wherein when the tip of the clip is lifted up causing the nub to be disengaged, the rotor draws back to a holding position while being rotated.

Japanese Patent No. 3327879 discloses a system in which when a protuberance of a clip nub comes in collision with a protuberance of a rotor, the rotor stops rotating at a writing position enabling the writing to be effected.

However, the systems disclosed by the above two documents are accompanied by problems as described below. That is, the sum of diameter of a refill (ink container), thickness of a knock member and thickness of the holder becomes the outer diameter of the holder resulting in an increase in the diameter of the holder.

Further, because of such a relationship that the knock member (rotor) engages with the clip nub, it becomes necessary to attain an engaging position. There, a problem remains in that the knocking member must be to be long causing the length of the refill to be shortened correspondingly, the amount of the ink to be decreased and the writing distance to be shortened.

A further problem is that, in order to cope with the above problem, the knock member is extended toward the end of the holder up to a position of a hole with which the nub of the clip engages, and the refill is buried in the knock member. Therefore, the remaining amount of the ink cannot be seen from the outer side.

Japanese Patent No. 3730574 discloses a system in which a moving element that engages with the rotor is brought into engagement with a clip nub due to a protuberance on the side opposite to the engaging portion.

However, the system of this document, is also accompanied by a problem in that, if the knocking operation is effected under such conditions that the safety mechanism has already functioned, the pen point thrusts out, but simply draws back and is not set to the writing position.

DISCLOSURE OF THE INVENTION

An object of this invention is to solve the above problems and to provide a writing instrument featuring a fine holder diameter, a short holder length, a long refill, maintaining good legibility of the remaining amount of the ink, and enabling the pen point to thrust out through one time of knocking operation in a customary manner even after the safety function has worked.

According to the present invention, there is provided a knock-type writing instrument comprising a refill having a writing portion at an end thereof, a spring for urging the refill backward, and a knock rod that is linked to the refill and protrudes beyond a holder, wherein upon depressing the knock rod, the refill is brought to a writing position protruding beyond the front part of the holder and an engaging nub of a clip is engaged with an engaging protuberance of a slide body to maintain the writing position; and wherein a rotor is provided between the knock rod and the refill in front thereof to support the refill, the knock rod and the rotor have first tilted cam surfaces corresponding to each other, and the rotor rotates in only one direction by only a predetermined angle each time due to the reactive force of the spring and responsive to the knocking operation forward and backward in the axial direction; when the knocking operation is effected in a state where the refill is contained in the holder, a second tilted cam surface formed on the rotor comes in contact with a corresponding tilted cam surface of the slide body, a perpendicular surface of the second cam of the rotor comes in contact with a vertical wall of a cam provided in the holder and maintains the refill at a writing position being supported by the load in the axial direction and by the rotational force; when the knocking operation is effected in a state where the refill is at the writing position, the second tilted cam surface of the rotor comes in contact with the tilted cam surface of the holder and, further, rotates upon coming in contact with the tilted cam surface provided in the inner cylinder, and moves to a retreated limit position to maintain the refill at the holding position; the slide body that can move in the lengthwise direction has an inward protuberance in a cut-away portion formed in the inside of the clip of the holder; when the refill is at the writing position, the inward protuberance is brought into engagement with a rear end of the second cam of the rotor, and an engaging protuberance formed on the slide body engages with an engaging step formed in the clip body to maintain the refill at the writing position; when the engagement is released between the engaging protuberance of the slide body and the engaging step of the clip body, the refill is returned by the spring back to the retreated position together with the slide body, and the second cam of the rotor moves to the retreated limit position passing through a gap formed at the back of the tilted cam surface of the holder to maintain the refill at the holding position; and when the knocking operation is effected in a state where the slide body is returned back to the retreated position and the refill is at the holding position, the engaging protuberance of the slide body engages with the engaging step of the clip body and, at the same time, the refill moves to the writing position by the above method and is held at this position.

BEST MODE FOR CARRYING OUT THE INVENTION

Figure 1A:
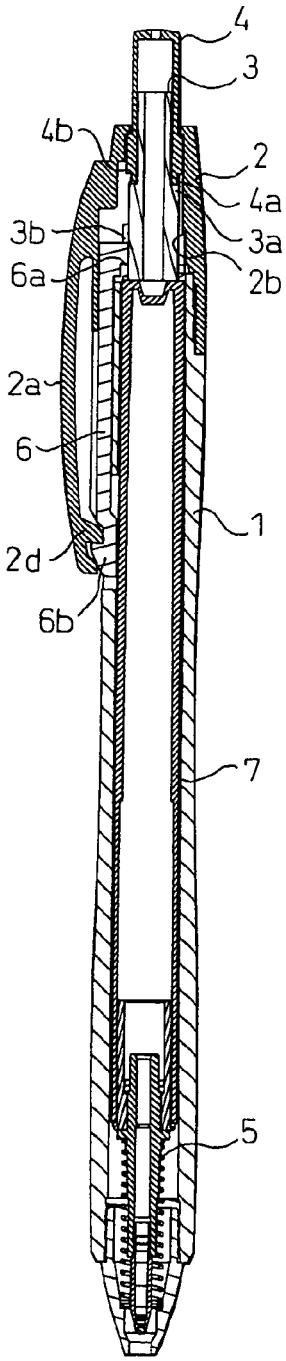
FIG. 1A is a sectional view of a knock-type writing instrument according to an embodiment, and shows a state where a refill is at the holding position.
Figure 1B:
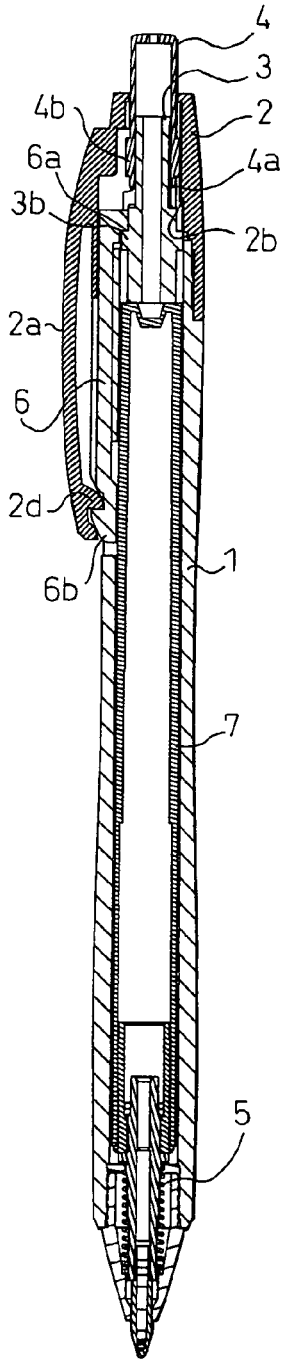
FIG. 1B is a sectional view of the knock-type writing instrument according to the embodiment, and shows a state where the refill is at the writing position.
Figure 1C:
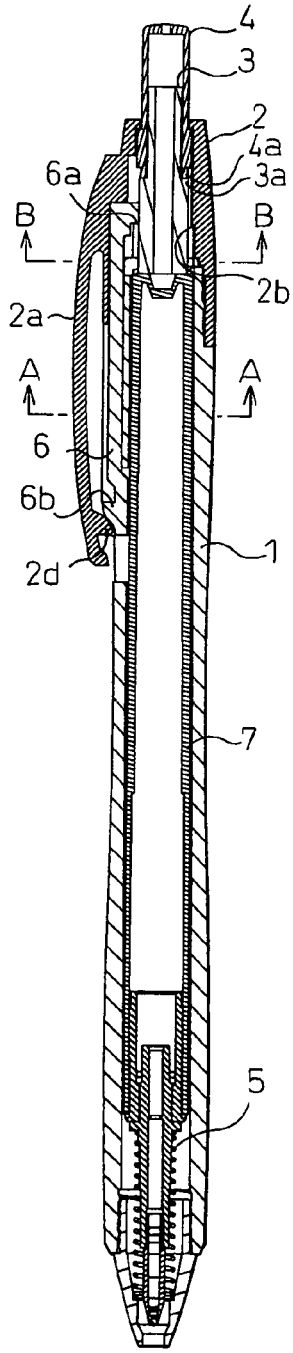
FIG. 1C is a sectional view of the knock-type writing instrument according to the embodiment, and shows a state where the refill is at the holding position after the safety operation.
Figure 2:
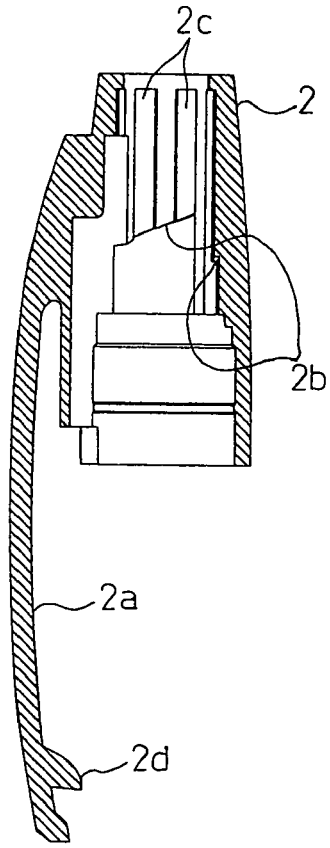
FIG. 2 is a sectional view of a clip according to the embodiment.

Embodiments of the invention will now be concretely described based on the drawings. FIG. 1A to FIG. 1C show a knock-type ballpoint pen to which only, however, the invention is in no way limited. FIG. 1A shows a state where a refill is at the holding position, FIG. 1B shows a state where the refill is at the writing position, and FIG. 1C shows a state where a safety mechanism has worked and the refill has returned back to the holding position.

The knock-type writing instrument of the embodiment comprises a refill 7 having a writing portion at an end thereof, a spring 5 for urging the refill 7 backward, and a knock rod 4 that is linked to the refill 7 and protrudes beyond a holder 1. Upon depressing the knock rod 4, the refill 7 is brought to a writing position protruding beyond the front part of the holder 1 and an engaging nub 2*d* of a clip is engaged with an engaging protuberance 6*b* of a slide body 6 to maintain the writing position. A rotor 3 is provided between the knock rod 4 and the refill 7 in front thereof to support the refill 7. The knock rod 4 and the rotor 3 have a knock rod cam 4*a* and a knock cam 3*a* forming tilted cam surfaces corresponding to each other, and the rotor rotates in only one direction by only a predetermined angle each time responsive to the forward knocking operation in the axial direction.

Further, when no longer depressed after the knocking operation, the refill 7 is urged backward at all times by the spring 5 and rotates in the same direction as the direction in which the knock rod 4 and the rotor 3 rotate due to a cam protuberance 3*b* of the rotor 3 and a corresponding cam 2*b* of an inner cylinder 2. That is, the rotor 3 rotates by a predetermined angle, and rotates once at a given timing (after two times of knocking in this embodiment) to repeat the operation.

The constituent parts will be described below in detail.

The inner cylinder 2 shown in FIG. 1A to FIG. 1C and FIG. 2 is constituted integrally with a clip 2*a*. On the inner wall surface of the inner cylinder, there are arranged grooves 2*c* for stopping the turn of the knock rod 4 and an inner cylinder cam 2*b* for positioning the refill 7. Further, the engaging nub 2*d* for engagement with the slide body 6 is formed at an end of the clip 2*a*.

The knock rod 4 shown in FIG. 1A to FIG. 1C and FIG. 4 is a cylindrical member disposed at the tail end of the writing instrument, and has a knock rod cam 4*a* at an end portion thereof and turn stops 4*b* arranged on the outer circumferential portion near the end thereof to slide in the grooves 2*c*.

The rotor 3 shown in FIG. 1A to FIG. 1C and FIG. 5 is a cylindrical member having a knock cam 3*a* that comes in contact with the knock rod cam 4*a* of the knock rod 4 and a cam protuberance 3*b* for positioning the refill 7.

The knock rod cam 4*a* and the knock cam 3*a* have mountain-shaped tilted cam surfaces corresponding to each other, and are arranged with their mountain-shaped pitches being deviated, whereby the rotor 3 receives a rotational force in a predetermined direction responsive to the knocking operation in the axial direction. Therefore, the rotor 3 rotates in a predetermined direction responsive to each knocking operation accompanied by the operation of the cam protuberance 3*b* that will be described later.

Further, the end portion of the rotor 3 is in contact with the rear end portion of the refill 7 at all times, and the position of the cam protuberance 3*b* in the back and forth direction determines the pen point position at the end of the refill 7.

Figure 3A:
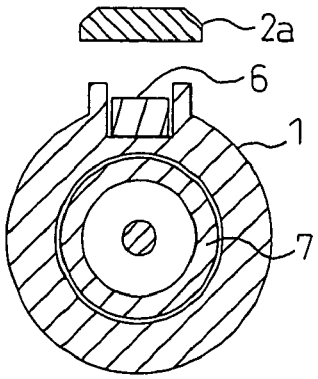
FIG. 3A is a sectional view along the A-A section of FIG. 1C.
Figure 3B:
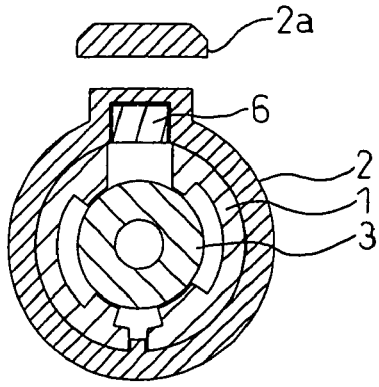
FIG. 3B is a sectional view along the B-B section of FIG. 1C.
Figure 4:
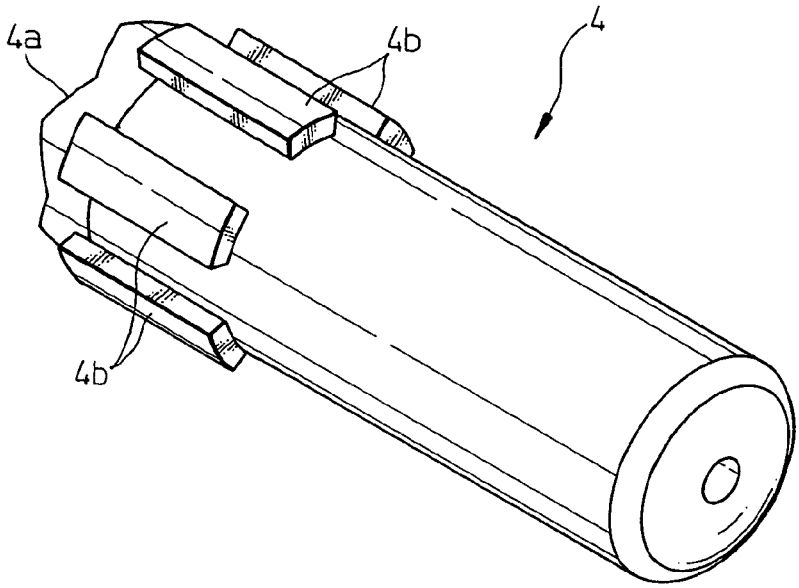
FIG. 4 is a perspective view of a knock rod according to the embodiment.
Figure 5:
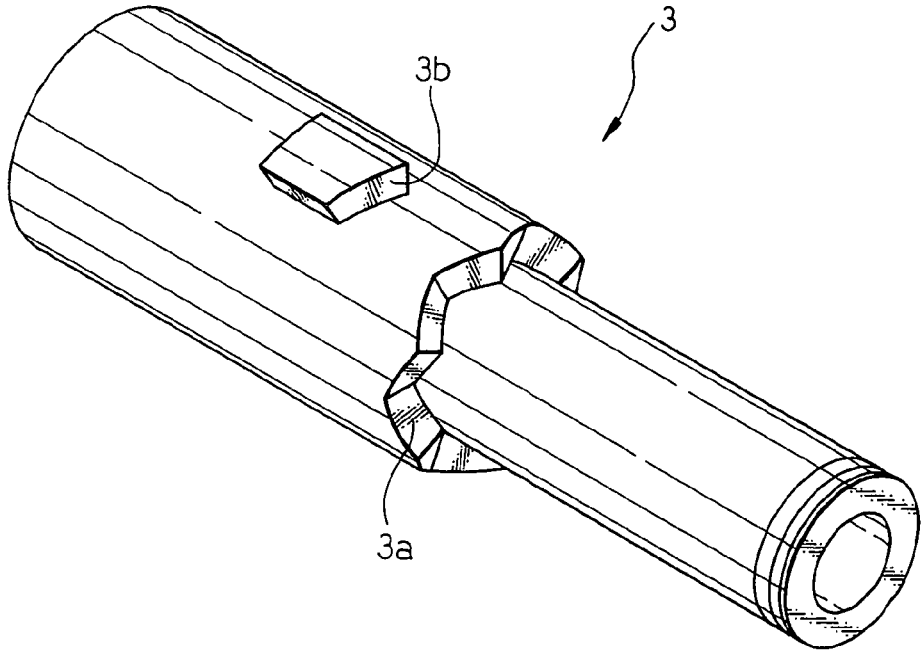
FIG. 5 is a perspective view of a rotor according to the embodiment.
Figure 6:
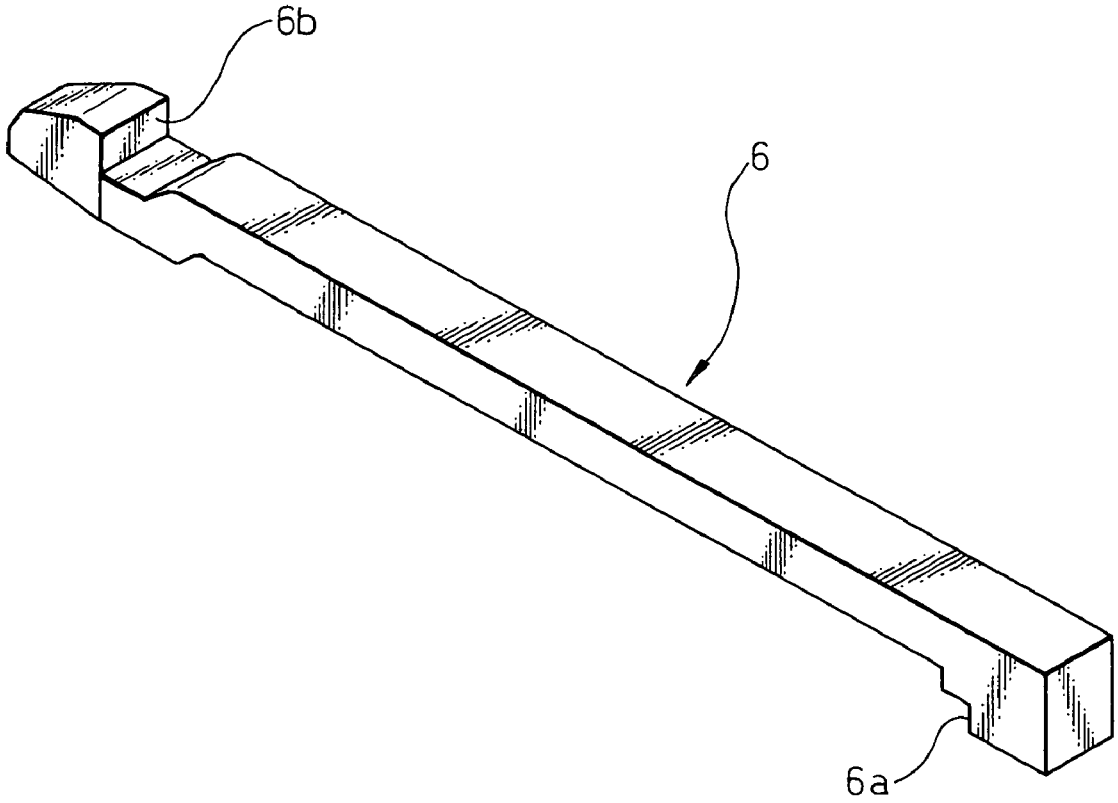
FIG. 6 is a perspective view of a slide body according to the embodiment.

The slide body 6 shown in FIG. 1A to FIG. 1C, FIG. 3A and FIG. 3B is a rod-like member, is provided in a cut-away portion (FIG. 3A) formed in the holder 1 on the inside of the clip 2*a* as shown in FIG. 1A to FIG. 1C, FIG. 3A and FIG. 3B, and is exposed to the outer side of the holder 1. The rear end portion of the slide body 6 is fitted in a groove formed in the inner surface of the inner cylinder 2 so as to slide therein (FIG. 3B).

The slide body 6 has a slide body cam 6*a* at a rear end on the inside thereof and with which will come in contact the cam protuberance 3*b* of the rotor 3, and, further, has an engaging protuberance 6*b* at an end on the outer side thereof and with which will come in engagement the engaging nub 2*d* of the clip 2*a*.

A spring 5 is arranged at an end of the housing 1 on the inside thereof to urge the knock rod 4 outward.

Next, the action of the thus constituted knock-type writing instrument will be described. First, the knocking operation will be described.

The knocking operation is an operation of depressing the knock rod 4 until it is released by removing a finger therefrom, and stands for a case where the pen point is moved from the retreated state to the writing position. On the other hand, the knock release is an operation of similarly depressing the knock rod 4 until it is released, but stands for a case where the pen point is moved from the writing position to the holding position.

Upon knock-operating the knock rod 4, the rotor 3 and the refill 7 move forward being pushed by the knock rod.

As described above, the rotor 3 is imparted with a rotational force (due to a relationship between the knock rod cam 4*a* and the knock cam 3*a*) but is restricted from rotating by a vertical wall of the inner cylinder cam 2*b*. If the cam protuberance 3*b* of the rotor 3 moves forward to a position beyond the vertical wall of the inner cylinder cam 2*b*, there is no restriction and the rotor 3 slightly rotates.

If hand is removed from the knock rod 4, the cam protuberance 3*b* of the rotor 3 undergoes a rotational motion along the inner cylinder cam 2*b*. In the ordinary cam knock, the inner cylinder cam 2*b* has been so cut that the rotation stops at the writing position upon hitting the vertical wall of the inner cylinder cam 2*b*. According to the above constitution, however, the cam protuberance 3*b* of the rotor 3 stops rotating upon hitting the vertical wall of the holder cam 1*a*. At the a when the rotation stops, the pen point at the end of the refill 7 assumes the writing position.

At this moment, further, the cam protuberance 3*b* of the rotor 3 is on the slide body cam 6*a* moving from the inner cylinder cam 2*b*. The load exerted on the rotor 3 in the axial direction thereof, i.e., the load due to the reacting force of the spring 5 and the writing, is transmitted from the cam protuberance 3*b* of the rotor 3 to the slide body cam 6*a*, and is supported by a portion where the engaging protuberance 6*b* of the slide body 6 is in engagement with the engaging ball 2*d* of the clip 2*a*.

The invention will be described in further detail with reference to schematic views.

FIG. 7A to FIG. 7E are schematic views illustrating the motion of the cam protuberance 3*b* of the rotor 3 when the knocking operation is effected, and a positional relationship among the inner cylinder cam 2*b*, slide body cam and holder cam 1*a*. They show the positions of the cams with respect to development of the inner cylinder cam 2*b* formed on the inner surface of the inner cylinder 2. The upper side in the drawing is the direction of the pen point. The cam protuberance 3*b* of the rotor 3 is imparted with the rotational force due to the cam mechanism of the knock rod 4 and the rotor 3, and, therefore, moves from the left toward the right in the drawing for every knocking operation.

Figure 7A:
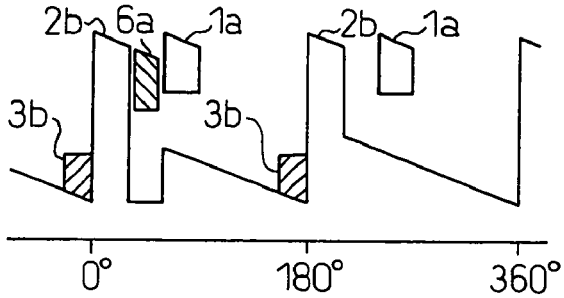
FIG. 7A to FIG. 7E are schematic views illustrating the knocking operation of the knock-type writing instrument according to the embodiment.
Figure 7B:
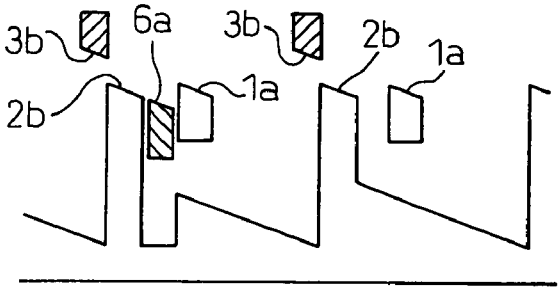
Figure 7C:
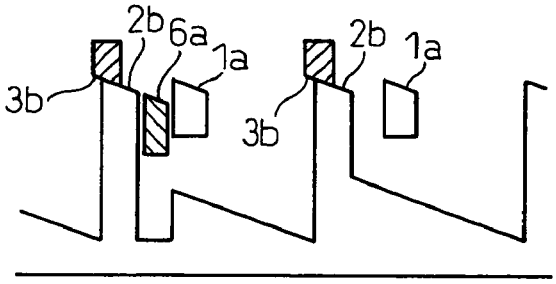
Figure 7D:
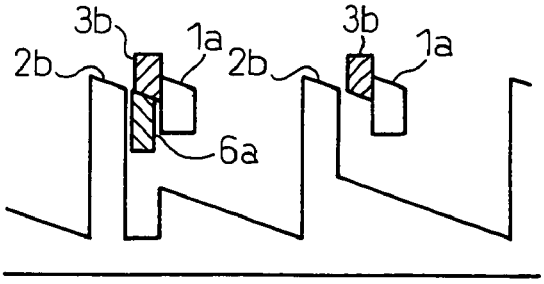
Figure 7E:
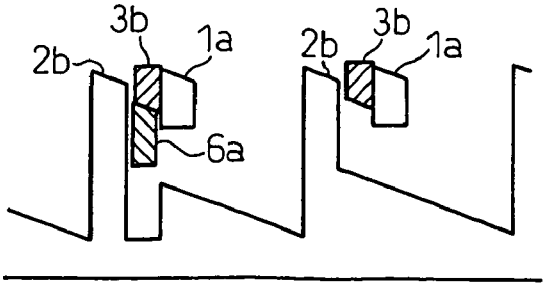

FIG. 7A shows a state where the pen point has retreated in an ordinary mode. If the knock rod 4 is depressed in this state, the cam protuberance 3*b* of the rotor 3 moves forward and reaches a position beyond the vertical wall of the inner cylinder cam 2*b* as shown in FIG. 7B. At this moment, the cam protuberance 3*b* is no longer restricted by the vertical wall of the inner cylinder cam 2*b* and slightly rotates rightward in the drawing. If a finger is removed, the cam protuberance 3*b* of the rotor 3 is pushed onto the surface of the inner cylinder cam 2*b* due to the reactive force of the spring 5, assumes a positional relationship as shown in FIG. 7C, and slides along the tilted surface to establish a state shown in FIG. 7D. Here, the rotation of the rotor 3 stops being restricted by the vertical wall of the holder cam 1*a*, and the load is received by the surface of the slide body cam 6*a*. As shown in FIG. 7E, further, the cam protuberance 3*b* of the rotor 3 is pushed up to a predetermined position where the load in the rotational direction due to a partial force of the load in the axial direction is reliably received by the vertical wall of the holder cam 1*a* and, thereafter, retreats. Therefore, a predetermined play is provided in the engaging portion between the engaging nub 2*d* of the clip and the engaging protuberance 6*b* of the slide body.

Next, the knock release will be described.

If the knock rod 4 is knock-operated, the pen point is pushed by the knock rod 4 from the writing position, and the rotor 3 and the refill 7 move forward. The rotor 3 has been imparted with the rotational force but is restricted from rotating due to the vertical wall of the holder cam 1*a* as described above. If the cam protuberance 3*b* of the rotor 3 moves forward up to a position beyond the vertical wall of the holder cam 1*a*, the rotor 3 slightly rotates since there is no restriction. If hand is removed from the knock rod 4, the cam protuberance 3*b* of the rotor rotates along the holder cam 1*a*.

Due to the reactive force of the spring 5, the cam protuberance 3*b* of the rotor 3 slides on the surface of the holder cam 1*a* exceeding the range of the holder cam 1*a* and, further, slides while being pushed onto the surface of the inner cylinder cam 2*b* in the subsequent stage, and stops upon coming in contact with the vertical wall of the inner cylinder cam 2*b*. This position is a position where the refill 7 is held.

Figure 8A:
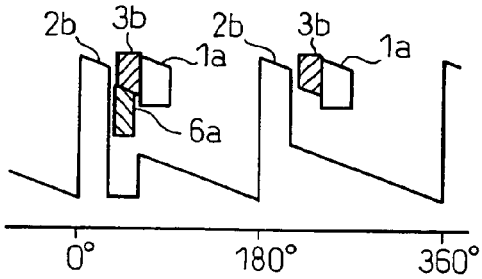
FIG. 8A to FIG. 8F are, similarly, schematic views illustrating the knock release.
Figure 8D:
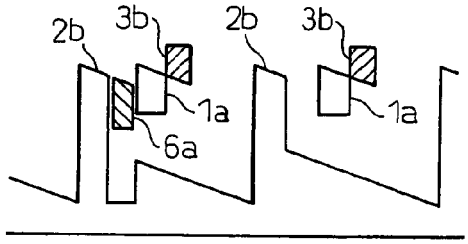
Figure 8B:
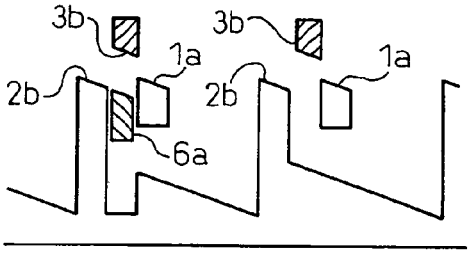
Figure 8E:
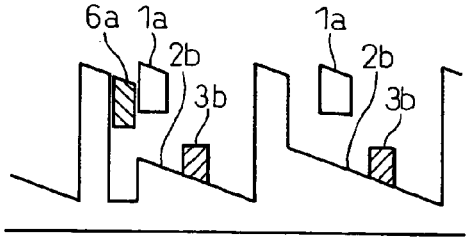
Figure 8C:
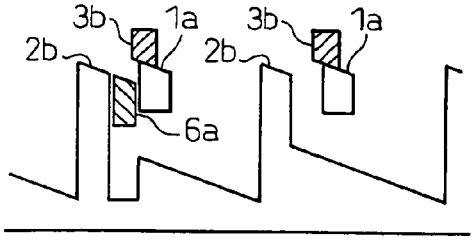
Figure 8F:
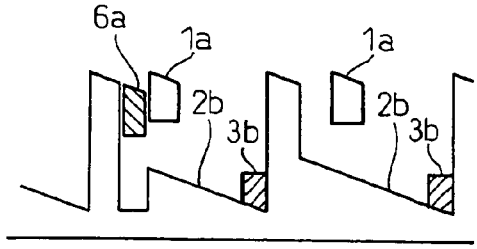

The above operation will be described in further detail with reference to FIG. 8A to FIG. 8F. FIG. 8A shows a position of the cam protuberance 3*b* of the rotor 3 of when the pen point is at the writing position. Here, if the knock rod 4 is depressed to effect the knock release operation, the cam protuberance 3*b* of the rotor 3 that has moved forward being imparted with the rotational force due to the relationship between the knock rod cam 4*a* of the knock rod 4 and the knock cam 3*a* of the rotor 3, now moves beyond the vertical wall of the holder cam 1*a* (FIG. 8B). If a finger is removed, therefore, the cam protuberance 3*b* is no longer restricted by the vertical wall, moves sliding on the tilted surface of the holder cam 1*a* (FIG. 8C) due to the rightward rotational force in the drawing and the reactive force of the spring 5. After having moved out of a range where it was in contact with the tilted surface of the holder cam 1*a* (FIG. 8D), the cam protuberance 3*b* is pushed onto the rear end surface of the inner cylinder cam 2*b* due to the reactive force of the spring 5 (FIG. 8E). Then it slides on the cam surface and stops upon coming in contact with the vertical wall at the rear end portion (FIG. 8F). Here, the pen point is at the holding position.

Next, the operation of the safety mechanism will be described.

If the clip 2*a* is lifted up in a state where the pen point is at the writing position, the engaging protuberance 6*b* of the slide body 6 is disengaged from the engaging nub 2*d* at the end of the clip 2*a*. The refill 7 is pushed rearward by the spring 5. After having been disengaged, therefore, the refill 7, rotor 3 and slide body 6 move backward.

The retreating motion of the slide body 6 has been restricted. If the slide body 6 has retreated to its limit, therefore, the cam protuberance 3*b* of the rotor 3 is no longer restricted by the vertical wall of the holder cam 1*a* and is allowed to rotate. Further, if the slide body 6 has reached to its retreat limit, a positional relationship is such that the slide body cam 6*a* and the inner cylinder cam 2*b* have nearly the same height, whereby the cam protuberance 3*b* of the rotor 3 rotationally moves from the slide body cam 6*a* onto the inner cylinder cam 2*b*, and the pen point arrives at the holding position.

The above operation will be described in further detail with reference to FIG. 9A to FIG. 9D.

Figure 9A:
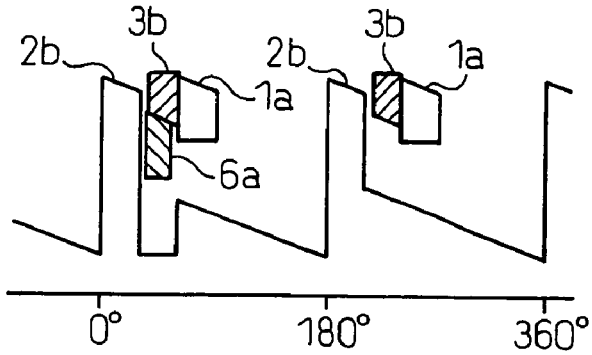
FIG. 9A to FIG. 9D are, similarly, schematic views illustrating the safety operation.
Figure 9B:
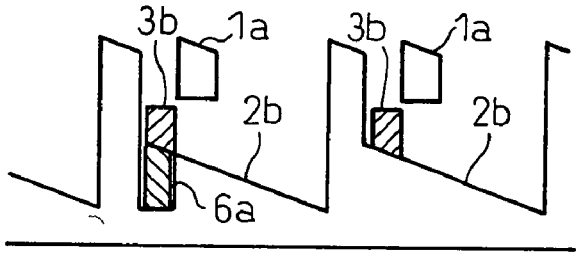
Figure 9C:
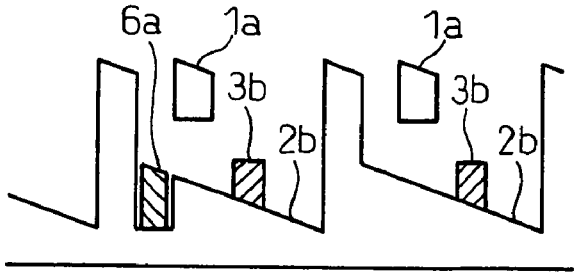
Figure 9D:
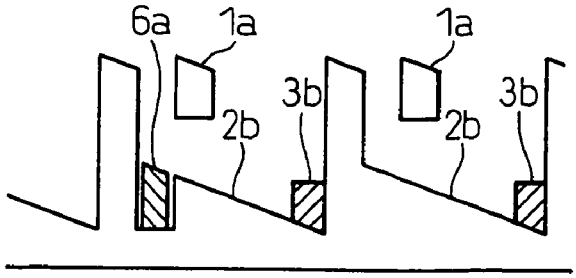

FIG. 9A shows a position of the cam protuberance 3*b* of the rotor 3 of when the pen point is at the writing position. In this state, if the engaging protuberance 6*b* of the slide body 6 disengages from the engaging nub 2*d* at the end of the clip 2*a* as described above, the rotor 3 retreats together with the slide body 6 due to the reactive force of the spring 5. Therefore, the cam protuberance 3*b* of the rotor 3 and the slide body cam 6*a* retreat up to the rear end surface of the inner cylinder cam 2*b* while being in contact with each other (FIG. 9B). At this position, there is no restriction by the vertical wall of the holder cam 1*a*, and the slide body cam 6*a* and the inner cylinder cam 2*b* have nearly the same height. Therefore, the cam protuberance 3*b* of the rotor 3 slides on the tilted surface of the inner cylinder cam 2*b* due to the reactive force of the spring 5 (FIG. 9C) and stops upon coming in contact with the vertical wall at the rear end portion (FIG. 9D). At this moment, the pen point is at the holding position. In this state, however, the slide body 6 remains retreated, and the slide body cam 6*a* is at rest at the retreated limit position.

Next, described below is the operation after the safety operation.

After the safety has worked, the slide body 6 is pushed by an end of the turn stop 4*b* of the knock rod 4 in response to a first knocking operation, and returns to the predetermined position. Described below with reference to FIG. 10A to FIG. 10C is the operation after the safety operation until returning back to the ordinary knocking operation.

Figure 10A:
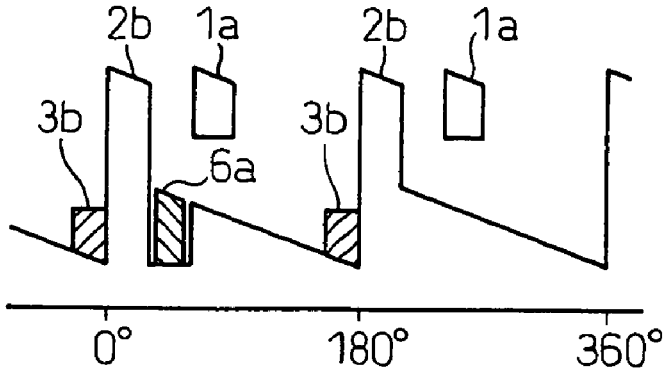
FIG. 10A to FIG. 10C are, similarly, schematic views illustrating the motion after the safety operation.
Figure 10B:
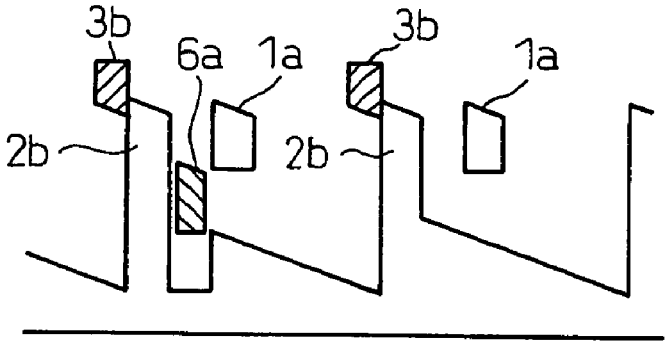
Figure 10C:
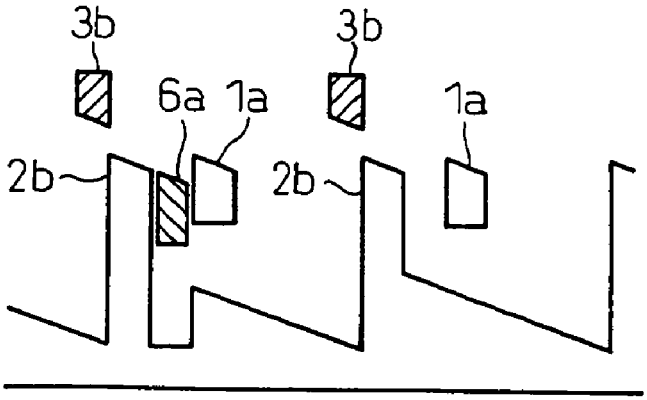
Figure 11A:
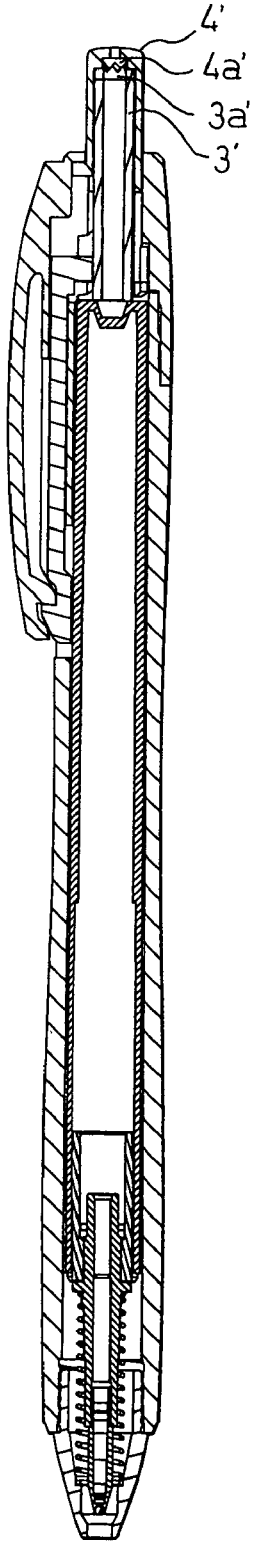
FIG. 11A is a sectional view of the knock-type writing instrument according to another embodiment of the invention, and shows a state where the refill is at the holding position.
Figure 11B:
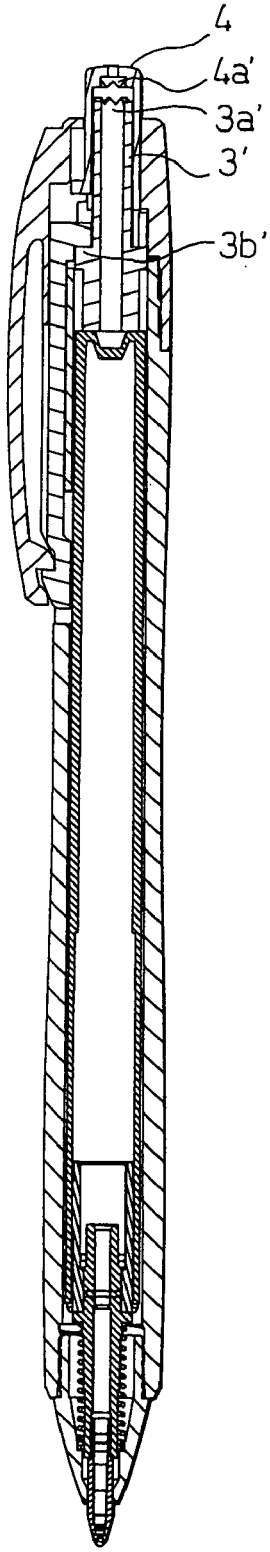
FIG. 11B is a sectional view of the knock-type writing instrument according to the another embodiment of the invention, and shows a state where the refill is at the writing position.
Figure 11C:
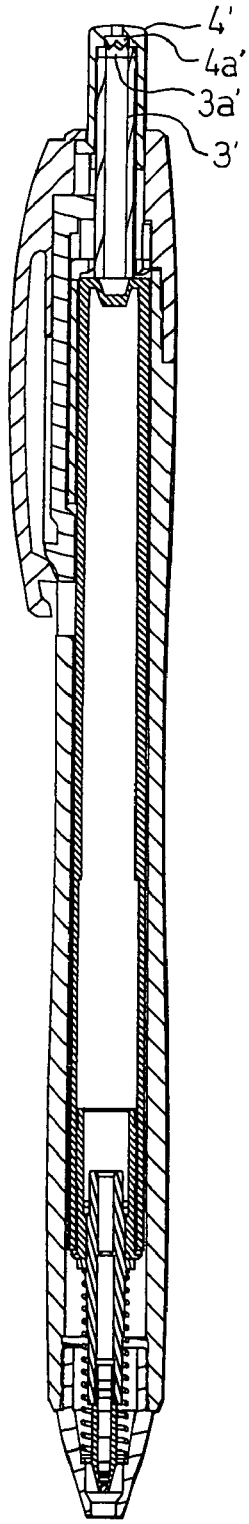
FIG. 11C is a sectional view of the knock-type writing instrument according to the another embodiment of the invention, and shows a state where the refill is at the holding position after the safety operation.
Figure 12:
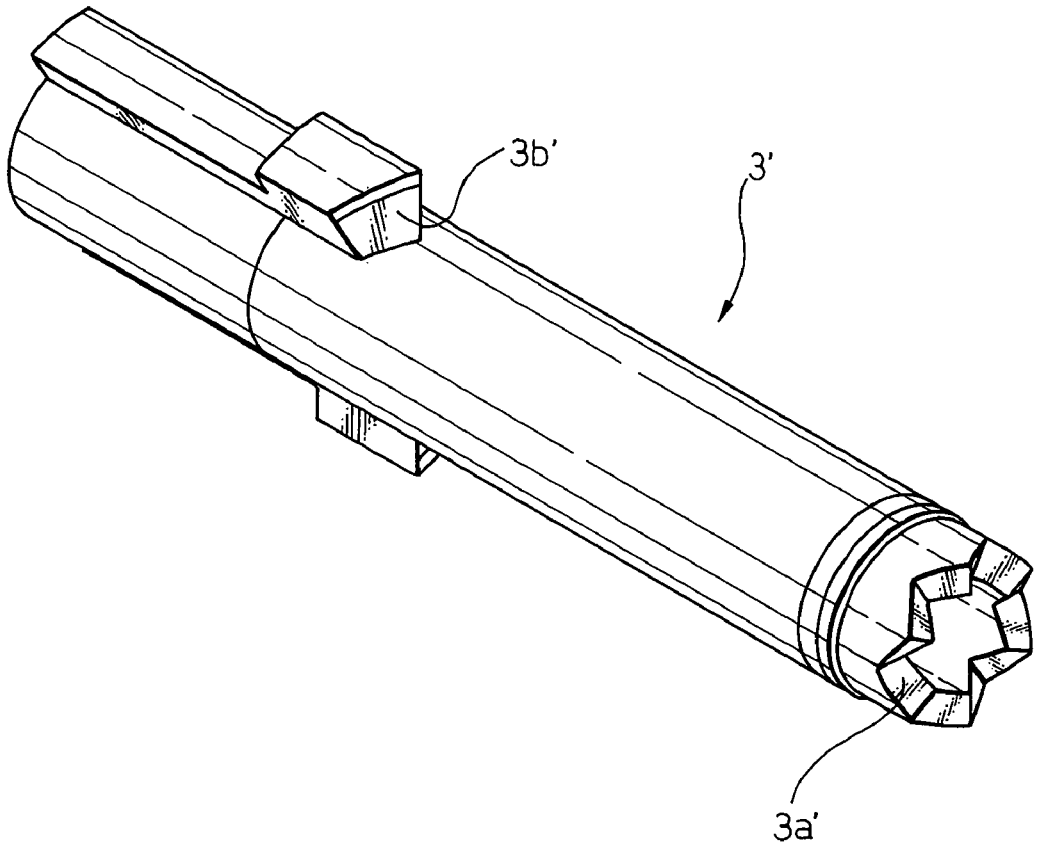
FIG. 12 is a perspective view of the rotor of the embodiment of FIG. 11A to FIG. 11C.

FIG. 10A shows the positions of the cam protuberance 3*b* of the rotor 3 and of the slide body cam 6*a* after the safety operation. If the knock rod 4 is depressed in this state, the end of the turn stop 4*b* of the knock rod 4 comes in contact with the rear end of the slide body 6 and moves forward whereby the engaging protuberance 6*b* of the slide body 6 engages with the engaging nub 2*d* at the end of the clip 2*a*. At the same time, the knock rod cam 4*a* of the knock rod 4 comes in contact with the knock cam 3*a* of the rotor 3 to move the rotor 3 forward. If the knock rod 4 is pushed to its forward limit, therefore, the cam protuberance 3*b* of the rotor 3 that has moved forward upon being imparted with the rotational force now moves beyond the vertical wall of the inner cylinder cam 2*b* (FIG. 10C).

This state is the same as the state (FIG. 7B) where the knock rod 4 is pushed up to its forward limit in the ordinary knocking operation. Therefore, if the knocking operation is completed by removing finger in this state, the cam protuberance 3*b* of the rotor 3 assumes the state of FIG. 7E where it is supported by the slide body cam 6*a* and the holder cam 1*a*, and the pen point is at the writing position. According to this embodiment as described above, the pen point can be set to the writing position upon one time of knocking operation from the state where the pen point was at the holding position either by the ordinary knock release (FIG. 8F) or after the safety has operated (FIG. 9D).

Next, another embodiment of the knock-type writing instrument of the invention will be described.

In this embodiment as shown in FIG. 11A to FIG. 11C and FIG. 12, a knock rod cam 4*a*' is arranged at the rear end of a knock rod 4' on the inside thereof, and a knock cam 3*a*' is arranged at the rear end of a rotor 3' to shorten a size from the rear end of the knock rod 4' to the front end of the rotor 3' in order to further shorten the overall length of the writing instrument yet maintaining the same refill length.

According to the knock-type writing instrument of the present invention as described above, the slide body is arranged in the cut-away portion of the holder under the clip so will not to hinder the writing or portability, and the safety mechanism is constituted being engaged with the clip. Unlike that of the prior art, therefore, the rotor does not have to be partly extended so as to engage with the clip. Since the sum of the refill diameter and the thickness of the holder becomes the diameter of the writing instrument, it is made possible to maintain fine the diameter of the holder and to shorten the length of the holder yet maintaining a large refill length.

Further, the knock mechanism and the safety mechanism are provided in the upper part of the holder, and other parts such as the inner cylinder are not overlapped on the ink legible portion of the refill. By making the holder transparent or by providing a transparent portion, therefore, the refill 7 is easily legible and the remaining amount of the ink can be easily confirmed lending the mechanism best suited for being adapted to the writing instrument of the direct liquid type.

Upon incorporating the slide body in a portion of the cam mechanism that guides the rotary motion of the rotor, further, there is provided a writing instrument which permits the pen point to thrust out through one time of knocking in an ordinary manner even after the safety function has worked.

List of Reference Numerals

1—holder
1*a*—holder cam
2—inner cylinder
2*a*—clip
2*b*—inner cylinder cam
2*d*—engaging boss
3—rotor
3*a*—knock cam
3*b*—cam protuberance
4—knock rod
4*a*—knock rod cam
4*b*—turn stop
5—spring
6—slide body
6*a*—slide body cam
6*b*—engaging protuberance
7—refill

What is claimed is

1. A knock-type writing instrument comprising a refill having a writing portion at an end thereof, a spring for urging the refill backward, and a knock rod that is linked to the refill and protrudes beyond a holder, wherein upon depressing the knock rod, the refill is brought to a writing position protruding beyond the front part of the holder and an engaging ball of a clip is engaged with an engaging protuberance of a slide body to maintain the writing position; and wherein a rotor is provided between the knock rod and the refill in front thereof to support the refill, the knock rod and the rotor have first tilted cam surfaces corresponding to each other, and the rotor rotates in only one direction by only a predetermined angle each time due to the reactive force of said spring and responsive to the knocking operation forward and backward in the axial direction;

when the knocking operation is effected in a state where said refill is contained in the holder, a second tilted cam surface formed on said rotor comes in contact with a corresponding tilted cam surface of said slide body, a perpendicular surface of the second cam of said rotor comes in contact with a vertical wall of a cam provided in said holder and maintains said refill at a writing position being supported by the load in the axial direction and by the rotational force; when the knocking operation is effected in a state where said refill is at said writing position, the second tilted cam surface of said rotor comes in contact with the tilted cam surface of said holder and, further, rotates upon coming in contact with the tilted cam surface provided in the inner cylinder, and moves to a retreated limit position to maintain said refill at the holding position;

said slide body that can move in the lengthwise direction has an inward protuberance in a cut-away portion formed in the inside of said clip of said holder;

when the refill is at the writing position, said inward protuberance is brought into engagement with a rear end of the second cam of said rotor, and an engaging protuberance formed on the slide body engages with an engaging step formed in the clip body to maintain the refill at the writing position;

when the engagement is released between the engaging protuberance of said slide body and the engaging step of the clip body, the refill is returned by said spring back to the retreated position together with the slide body, and the second cam of said rotor moves to the retreated limit position passing through a gap formed at the back of the tilted cam surface of said holder to maintain the refill at the holding position; and when the knocking operation is effected in a state where said slide body is returned back to the retreated position and the refill is at said holding position, the engaging protuberance of said slide body engages with the engaging step of the clip body and, at the same time, the refill moves to the writing position by the said method and is held at this position.

2. The knock-type writing instrument according to claim 1, wherein the first tilted cam surfaces of the knock rod and the rotor are formed on their end surfaces, respectively.

3. The knock-type writing instrument according to claim 1, wherein the knock-type writing instrument is a ballpoint pen.

4. The knock-type writing instrument according to claim 2, wherein the knock-type writing instrument is a ballpoint pen.

* * * * *